US010507973B2

(12) United States Patent
Park

(10) Patent No.: US 10,507,973 B2
(45) Date of Patent: Dec. 17, 2019

(54) FOLDABLE CONTAINER

(71) Applicant: KUMKANG KIND CO., LTD., Busan (KR)

(72) Inventor: Yong Jae Park, Yongin-si (KR)

(73) Assignee: KUMKANG KIND CO., LTD., Busan (KR)

( * ) Notice: Subject to any disclaimer, the term of this patent is extended or adjusted under 35 U.S.C. 154(b) by 197 days.

(21) Appl. No.: 15/544,821

(22) PCT Filed: Jan. 19, 2016

(86) PCT No.: PCT/KR2016/000539
§ 371 (c)(1),
(2) Date: Jul. 19, 2017

(87) PCT Pub. No.: WO2016/117903
PCT Pub. Date: Jul. 28, 2016

(65) Prior Publication Data

US 2018/0009602 A1 Jan. 11, 2018

(30) Foreign Application Priority Data

Jan. 19, 2015 (KR) ..... 10-2015-0008669

(51) Int. Cl.
*B65D 6/00* (2006.01)
*B65D 88/52* (2006.01)
(Continued)

(52) U.S. Cl.
CPC ..... *B65D 88/52* (2013.01); *B65D 88/12* (2013.01); *B65D 90/008* (2013.01); *B65D 90/0026* (2013.01)

(58) Field of Classification Search
CPC ..... B65D 88/12; B65D 88/522; B65D 88/52; B65D 88/524; B65D 90/008; B65D 90/0026
(Continued)

(56) References Cited

U.S. PATENT DOCUMENTS

| | | | |
|---|---|---|---|
| 3,752,349 | A | 8/1973 | Rana |
| 5,190,179 | A | 3/1993 | Richter et al. |
| 8,196,766 | B2 | 6/2012 | Schrayvogel |

FOREIGN PATENT DOCUMENTS

| | | | |
|---|---|---|---|
| CN | 101641268 | A | 2/2010 |
| DE | 2 212 559 | A | 9/1972 |

(Continued)

OTHER PUBLICATIONS

International Search Report in International Application No. PCT/KR2016/000539, filed Jan. 19, 2016.

*Primary Examiner* — Andrew T Kirsch
*Assistant Examiner* — Elizabeth J Volz
(74) *Attorney, Agent, or Firm* — Saliwanchik, Lloyd & Eisenschenk

(57) ABSTRACT

The present disclosure relates to a foldable container which includes a pair of side walls disposed side-by-side; a guide rail disposed in a direction transverse-crossing between lower ends of the one pair of side walls to guide movement of at least one of the side walls; an upper plate and a lower plate, wherein each of the upper plate and the lower plate is divided into at least two unit plates that are rotatably connected to each other so as to be folded by the movement of the side wall, and wherein each of the upper plate and the lower plate connects upper ends of the pair of side walls to each other and connects lower ends of the one pair of side walls to each other; and a door rotatably connected to each of a front end and a rear end of the side wall.

16 Claims, 10 Drawing Sheets

(51) Int. Cl.
*B65D 88/12* (2006.01)
*B65D 90/00* (2006.01)

(58) Field of Classification Search
USPC ..... 220/1.5, 6, 666, 4.28, 4.29
See application file for complete search history.

(56) References Cited

FOREIGN PATENT DOCUMENTS

| | | | | | |
|---|---|---|---|---|---|
| DE | 689 12 132 | T2 | | 7/1994 | |
| EP | 2 744 731 | A1 | | 6/2014 | |
| IT | 1189100 | B | | 1/1988 | |
| JP | 60-187277 | U | | 9/1985 | |
| JP | 05-147466 | A | | 6/1993 | |
| JP | 06-293382 | A | | 10/1994 | |
| JP | 2002-264993 | A | | 10/1994 | |
| JP | 2007-511431 | A | | 5/2007 | |
| JP | 2014-125279 | A | | 7/2014 | |
| KR | 10-1064803 | B1 | | 9/2011 | |
| WO | WO-2014/028000 | A2 | | 2/2014 | |
| WO | WO2014028000 | | * | 2/2014 | ..... B65D 88/524 |

* cited by examiner

FOLDABLE CONTAINER

CROSS-REFERENCE TO RELATED APPLICATIONS

This application is the U.S. national stage application of International Patent Application No. PCT/KR2016/000539, filed Jan. 19, 2016, which claims priority to Korean Application No. 10-2015-0008669, filed Jan. 19, 2015, the disclosures of each of which are incorporated herein by reference in their entirety.

FIELD

The present invention relates to a foldable container, and more particularly, to a foldable container that may be folded conveniently, and at the same time, that may be prevented from being folded arbitrarily by a stack load being applied in a vertical direction.

BACKGROUND

Generally, a container refers to an object having a large box shape made of steel plates, and mainly used in freight transportation. Such a container not only stores and carries freight easily, but also has an advantage of protecting the freight contained inside it, and is thus being widely used.

Such a container is either transferred by the piece by means of a big freight vehicle that is used exclusively, or in large volumes by means of an exclusive train or exclusive ship.

Since such a container is made of steel material, it will occupy the same amount of space regardless of whether it is loaded with freight or it is empty. Therefore, there is a problem that the volume and cost for storing or transferring an empty container are the same as those for carrying freight inside the container.

In order to solve this problem, there have been attempts to enable a container to be folded when it is in an empty state, thereby solving the aforementioned problem. That is, Korean Patent Registration no. 10-1064803 discloses adopting a belt and a rotation axis rod in order to fold a container in an empty state, and a structure where the belt is fixed to a side wall of the container so that the side wall can be folded by pulling the rotation axis rod.

However, to fold the container, the aforementioned conventional technology requires additional components to be mounted, i.e. the rotation axis rod and the belt, and there is a safety problem that the side wall may be suddenly folded by the belt being pulled, and also a problem of difficulty in folding the door instead of the side wall, etc.

Meanwhile, there is a conventional technology, Korean Patent Registration no. 10-0775446, that discloses a foldable container, having a ratchet gear at a lower side plate of a left and a right plate 300, so that the container may be folded and unfolded simply and conveniently.

However, in the aforementioned conventional technology, in the process of folding an upper side plate and a lower side plate which form the left and the right plate, a front plate and a rear plate must be rotated towards the inner side of the container, in which case, a serious safety problem may occur, if there is a worker inside the container performing the operation of folding the container. That is, if the side wall is folded in the process of folding the front plate in order to fold the front plate towards the inner side of the container, a serious accident may occur.

Especially, since a plurality of containers are supposed to be stacked in a vertical direction to be stored and transferred, if the side wall cannot sufficiently support load being applied in the vertical direction, there is a concern that not only the contents may be damaged but also the plurality of stacked containers may collapse. However, the aforementioned conventional type of foldable container has a structure where the upper plate and the lower plate closely contact each other as the side wall is folded, and thus the container becomes very vulnerable to the stacked load acting in the vertical direction, thereby causing a problem of not being able to stack a sufficient amount of containers. Further, since it uses a method where the upper plate and the lower plate closely contact each other as the side wall is being folded, if the side walls at both sides are arbitrarily folded by the vertical load, a big accident may occur.

SUMMARY

Therefore, a purpose of the present disclosure is to solve the aforementioned problems of prior art, that is, to provide a foldable container that may be folded conveniently, and that may be prevented from being folded arbitrarily by a stacked load being applied in a vertical direction.

The aforementioned purpose is achieved by a foldable container of the present disclosure, that includes a pair of side walls disposed side-by-side; a guide rail disposed in a direction transverse-crossing between lower ends of the one pair of side walls to guide movement of at least one of the side walls; an upper plate and a lower plate, wherein each of the upper plate and the lower plate is divided into at least two unit plates that are rotatably connected to each other so as to be folded by the movement of the side wall, and wherein each of the upper plate and the lower plate connects upper ends of the pair of side walls to each other and connects lower ends of the one pair of side walls to each other; and a door rotatably connected to each of a front end and a rear end of the side wall.

Here, it is preferable that a transfer cart configured to move along the guide rail is provided at the lower end of the side wall.

Further, it is preferable that a roller is provided at both end portions of the transfer cart, and the guide rail is provided with a guide groove configured to guide movement of the roller, and a stopper that is disposed at an upper side of the guide groove to prevent deviation of the roller.

Further, it is preferable that the guide rail includes a first rail fixed to one side wall of the pair of the side walls and a second rail rotatably connected to an end portion of the first rail to guide the movement of the other side wall of the pair of the side walls.

Further, it is preferable that the foldable container includes a first fixing portion provided on an outer surface of the other side wall to selectively fix the second rail.

Further, it is preferable that the foldable container includes a second fixing portion provided on the lower plate to selectively fix the lower plate to the first rail or to the second rail in a state where the lower plate is unfolded.

Further, it is preferable that the second fixing portion includes a fixing means disposed on an outer surface of the lower plate to be selectively engaged with the second rail, and a handle disposed on an inner surface of the lower plate to drive the fixing means in a fixing direction or in a releasing direction.

Further, it is preferable that the foldable container includes corner fitting members which are disposed at each corner of the one pair of side walls and which are supported on a bottom surface.

Further, it is preferable that, of the corner fitting members, the corner fitting member disposed at a lower end corner of the side wall moving along the guide rail, is disposed so as to be moveable up and down in a height direction of the side wall, and the corner fitting members are selectively supported on the bottom surface while being moved up and down by a manipulating lever provided at the side wall.

Further, it is preferable that the corner fitting member is provided with a first coupling hole each formed at a position corresponding to an upper surface and a lower surface of the side wall, and a second coupling hole each formed at a position corresponding to an outer surface of the side wall, and a distance between the second coupling holes of the corner fitting members disposed at an upper end corner and at a lower end corner of the side wall is set to be identical to a distance between the first coupling holes of the corner fitting members provided at the one pair of side walls.

Further, it is preferable that each of the lower plate and the side wall has a fork groove into which a fork of a transfer equipment is inserted.

According to the present disclosure, there is provided a foldable container that may be folded conveniently, and that may be prevented from being folded arbitrarily by a stacked load being applied in a vertical direction.

DETAILED DESCRIPTION

Figure 1:
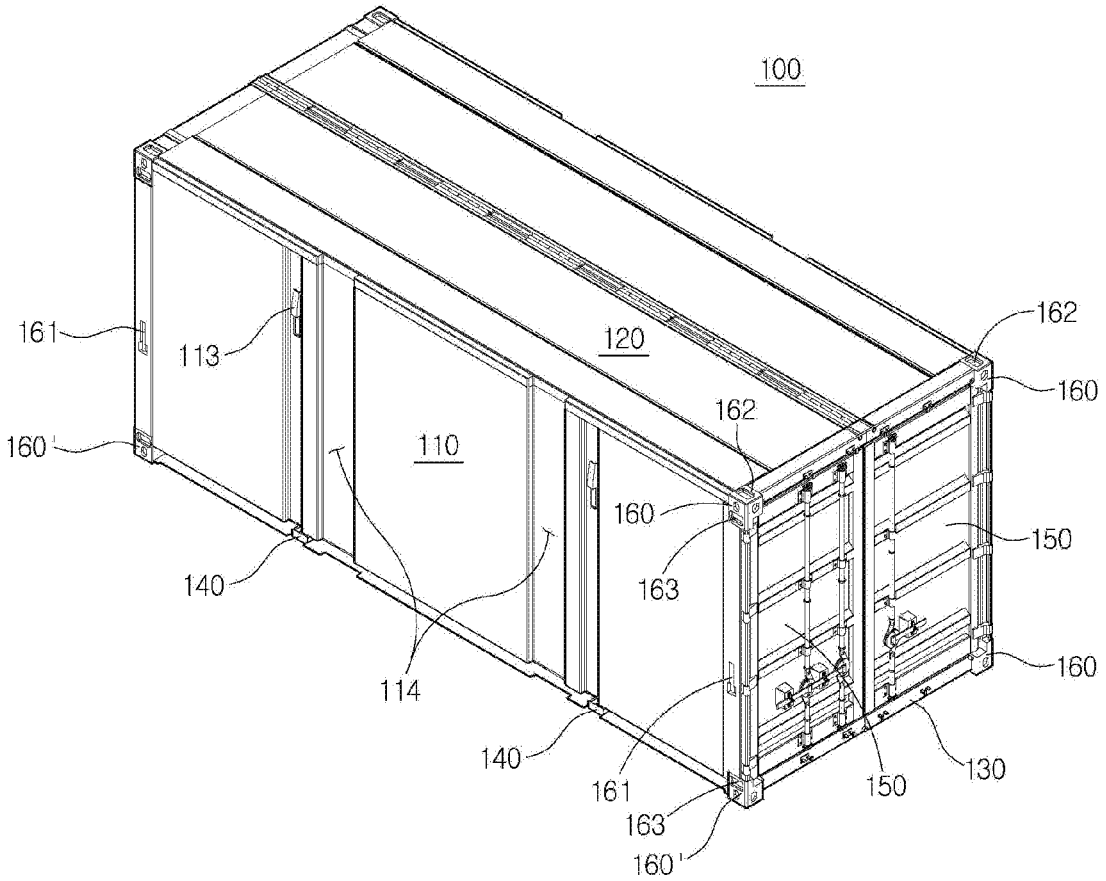
FIG. 1 is a perspective view of a foldable container of the present disclosure.

Prior to the description of the present disclosure, it should be noted that, like reference numerals will be used for like elements across various embodiments, and those elements will be described with reference to a first embodiment as a representative, and in the remaining embodiments, only the elements that are different from the first embodiment will be described.

Hereinafter, a foldable container 100 according to a first embodiment of the present disclosure will be described in detail with reference to the attached drawings.

Figure 2:
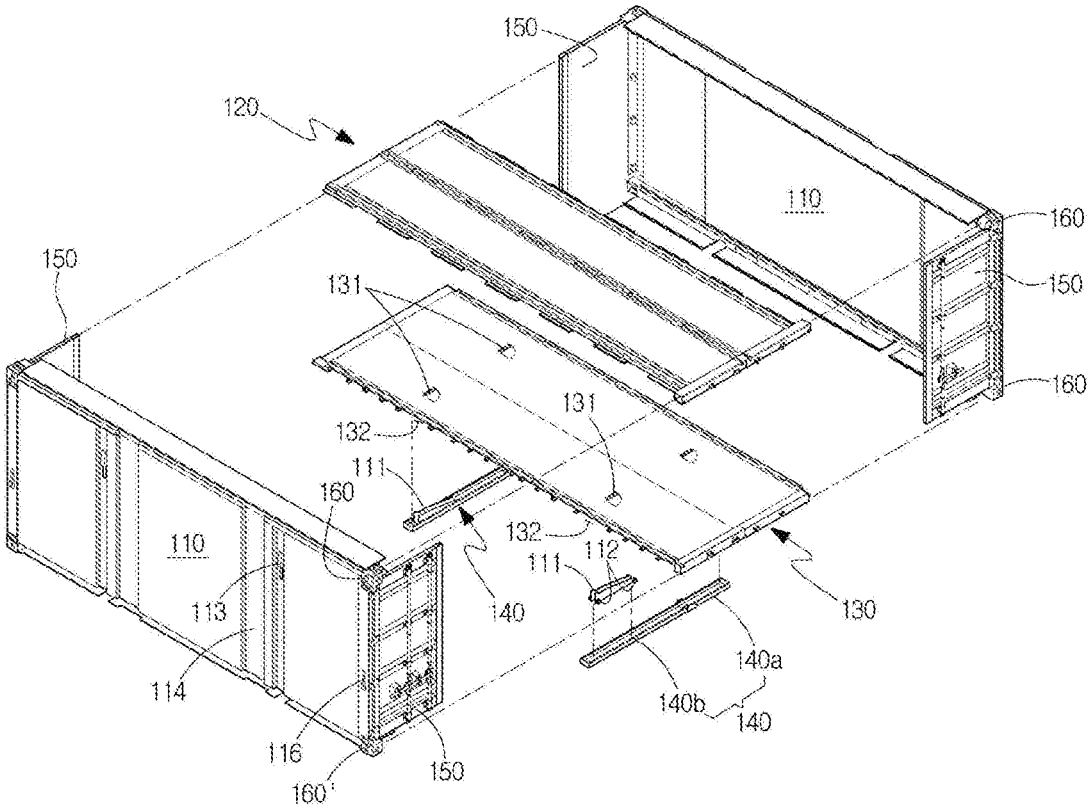
FIG. 2 is an exploded perspective view of the foldable container of the present disclosure.
Figure 3:
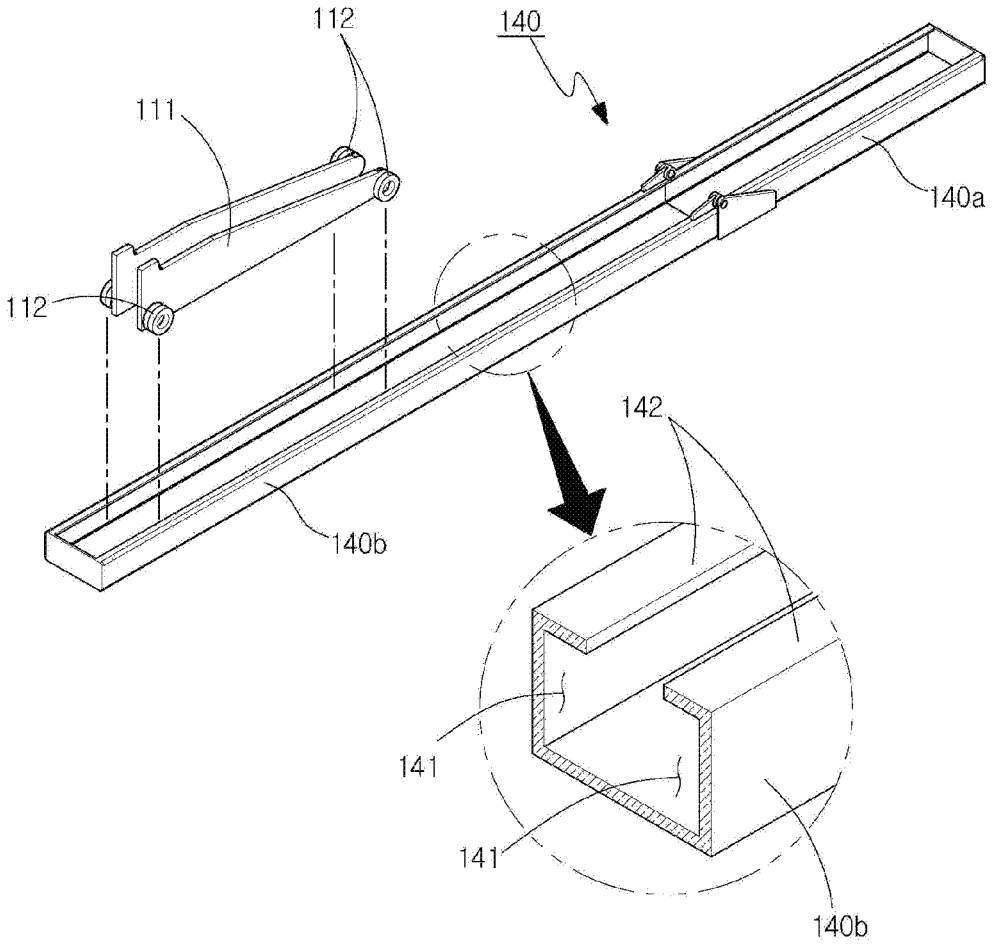
FIG. 3 is an extracted perspective view of a guide rail of the foldable container of the present disclosure.

Of the attached drawings, FIG. 1 is a perspective view of the foldable container of the present disclosure, FIG. 2 is an exploded perspective view of the foldable container of the present disclosure, and FIG. 3 is an extracted perspective view of a guide rail of the foldable container of the present disclosure.

The foldable container 100 of the present disclosure, as that illustrated in the aforementioned drawings, is configured to include one pair of side walls 110, a guide rail 140 disposed at a lower portion of the one pair of side walls 110 in a direction transverse-crossing between the side walls 110 so as to guide movement of the side wall 110, an upper plate 120 and a lower plate 130 which are respectively configured to be foldable and configured to connect upper ends of the one pair of side walls 110 to each other and to connect lower ends of the one pair of side walls 110 to each other, and a door 150 connected to each of a front end portion and a rear end portion of the one pair of side walls 110.

The side wall 110 is an element that forms both side surfaces of the container and the side walls 110 are displaced in a vertical direction and side-by-side. At the lower end of the side wall 110, there is provided a transfer cart 111 having a roller 112 at each of its front end and rear end so as to move along the guide rail 140.

The guide rail 140 is an element that is disposed at the lower end of the one pair of side walls 110, in a direction transverse-crossing between the side walls 110, so as to guide the movement of the side wall 110, and at both sides of the guide rail 140, a guide groove 141, for guiding the movement of the roller 112, is formed in a longitudinal direction of the guide rail 140, and at an upper side of the guide groove 141, a stopper 142 is formed to prevent the roller 112 from deviating. The guide rail 140 is configured to be divided into a first rail 140*a* that is fixed to the one side wall 110 of the pair of side walls, and a second rail 140*b* rotatably connected to an end portion of the first rail 140*a*. A plurality of such guide rails 140 may be provided for stable movement of the side wall 110, and the plurality of guide rails 140 are disposed side-by-side with a space therebetween.

Further, on an outer surface of the side wall 110 at another side, a first fixing portion 113, for selectively fixing the second rail 140*b* in a state where it is rotated to closely contact the outer surface of the side wall 110, is disposed. Such a first fixing portion 113 is an element for fixing the second rail 140*b* to the outer surface of the side wall 110, and a hook clamp such as a cicada-shaped hook clamp, configured to engage a hook formed at an end portion of the guide rail 140, may be applied to the first fixing portion 113. By preventing arbitrary movement of the side wall 110, it is possible to prevent the upper plate 120 and the lower plate 130 from being arbitrarily unfolded from a folded state.

The upper plate 120 and the lower plate 130 are elements that form the upper surface and the lower surface of the container, respectively and that are each configured to be divided into at least two unit plates, rotatably connected to each other, and the end portions of both sides are rotatably connected respectively to the upper end and to the lower end of the one pair of side walls 110. Such an upper plate 120 and a lower plate 130 are folded or unfolded by the movement of the one pair of side walls 110, thereby enabling the container to be folded.

Further, on the lower plate 130, there is provided a second fixing portion 131 that selectively fixes the lower plate 130 to the first rail 140*a* or to the second rail 140*b* in a state where the two unit plates are completely unfolded and thus the lower plate 130 closely contacts the guide rail 140. Such a second fixing portion 131 is configured to include a fixing means disposed on an outer surface of the lower plate 130 to selectively engage the second rail 140*b*, and a handle disposed on an inner surface of the lower plate 130 to rotate the fixing means in a fixing direction or in a releasing direction.

The second fixing portion 131 is an element for preventing the lower plate 130 from being arbitrarily folded in a state where the lower plate 130 is unfolded. The second fixing portion 131 may be configured in a variety of shapes such that it may be fastened to a through-hole provided in the guide rail 140 and may restrict the lower plate 130 from moving in a direction away from the guide rail 140, that is, in a folding direction. Specifically, the fixing means may be made in a rectangular-block shape that can be inserted into and/or pulled out from the second rail 140*b*, and the handle may rotate the rectangular fixing means such that both end portions of the fixing means can engage the guide groove 141.

The door 150 is an element that forms the front surface and/or the rear surface of the container, and that is rotatably disposed at each of the front end and the rear end of the one pair of side walls 110, so that it can finish an opening region of the front surface and the rear surface of the container, and rotate at the end portions of the side walls 110 to closely contact the inner surface or the outer surface of the side walls 110. Further, on the door 150, a locking means for fixing the position of the door 150 in an opened or closed state, may be provided.

Meanwhile, at each corner of the one pair of side walls 110, corner fitting members 160, 160' may be provided such that the container is supported on a bottom surface depending on a height or such that the container is fixed to an adjacent container or a transporting crane.

Of the corner fitting members 160, 160', the corner fitting member 160', that is disposed at a lower end corner of the side wall 110 moving along the guide rail 140, is disposed such that it can go up and down in a height direction of the side wall 110, and may be moved up or down by a manipulating lever 161 provided on the side wall 110, thereby being supported on the bottom surface or spaced apart from the bottom surface.

Further, the corner fitting members 160, 160' are each provided with a first coupling hole 162 at a position corresponding to the upper surface and the lower surface of the side wall 110, and a second coupling hole 163 at a position corresponding to the outer surface of the side wall, and a distance between the second coupling holes 163 of the corner fitting members 160, 160' disposed at the upper end corner and at the lower end corner of the side wall 110, is set to be identical to a distance between the first coupling holes 162 of the corner fitting members 160, 160' provided at the one pair of side walls 110.

Therefore, in a state where the container is unfolded, a fixing hook (not illustrated) provided on a bottom surface of a transfer means such as a ship, may be coupled to the first coupling hole 162 of the corner fitting members 160, 160', thereby fixing the container, and in a state where the container is folded, for a stable storage of the container, the container may be laid such that the side walls 110 face the bottom surface, and then the fixing hook (not illustrated) provided on the bottom surface of the transfer means, may be coupled to the second coupling hole 163 of the corner fitting members 160, 160', thereby fixing the container.

Further, on the lower plate 130, one pair of fork grooves 132 may be formed in a direction in which the fork groove transverse-crosses the container, so that the container may be transferred using a transfer equipment such as a forklift. Especially, in a state where the container is folded, the width of the container becomes narrow, causing the container to fall easily, and thus the container may be laid such that the side walls 110 face the bottom surface, so as to maintain a stable state, and a fork of the forklift may be inserted into the fork groove 114 formed in the side wall 110, so as to lift the container, and thus it is possible to prevent the container from falling in the process of transferring the container.

Hereinafter, an operation of a first embodiment of the aforementioned foldable container 110 will be described.

Figure 4:
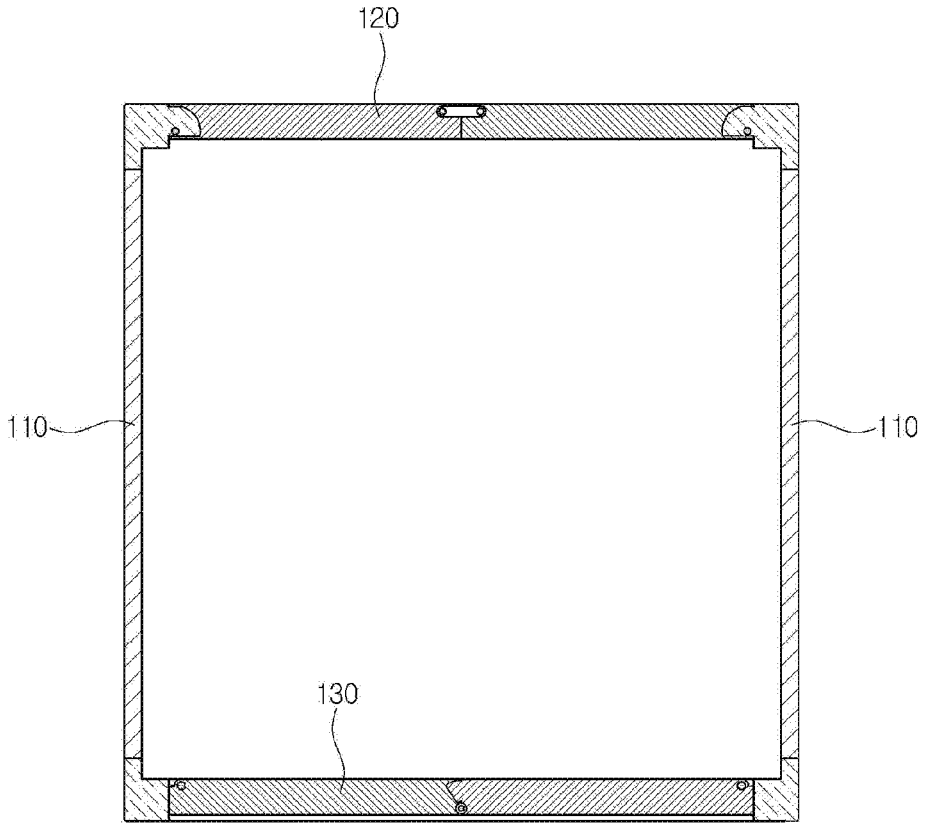
FIG. 4 is a front cross-sectional view of the foldable container of the present disclosure.
Figure 5:
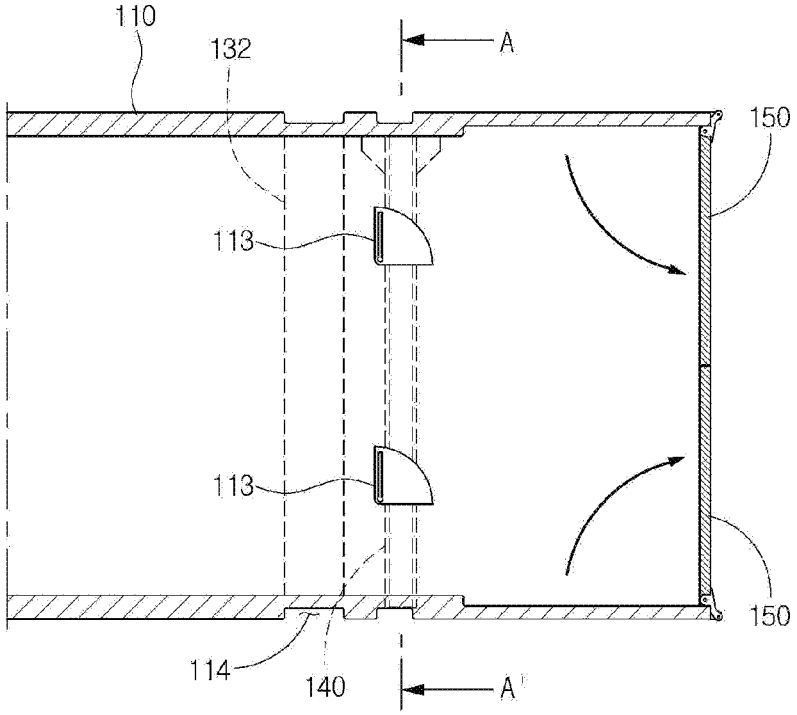
FIG. 5 is a plan cross-sectional view of the foldable container of the present disclosure.
Figure 6:
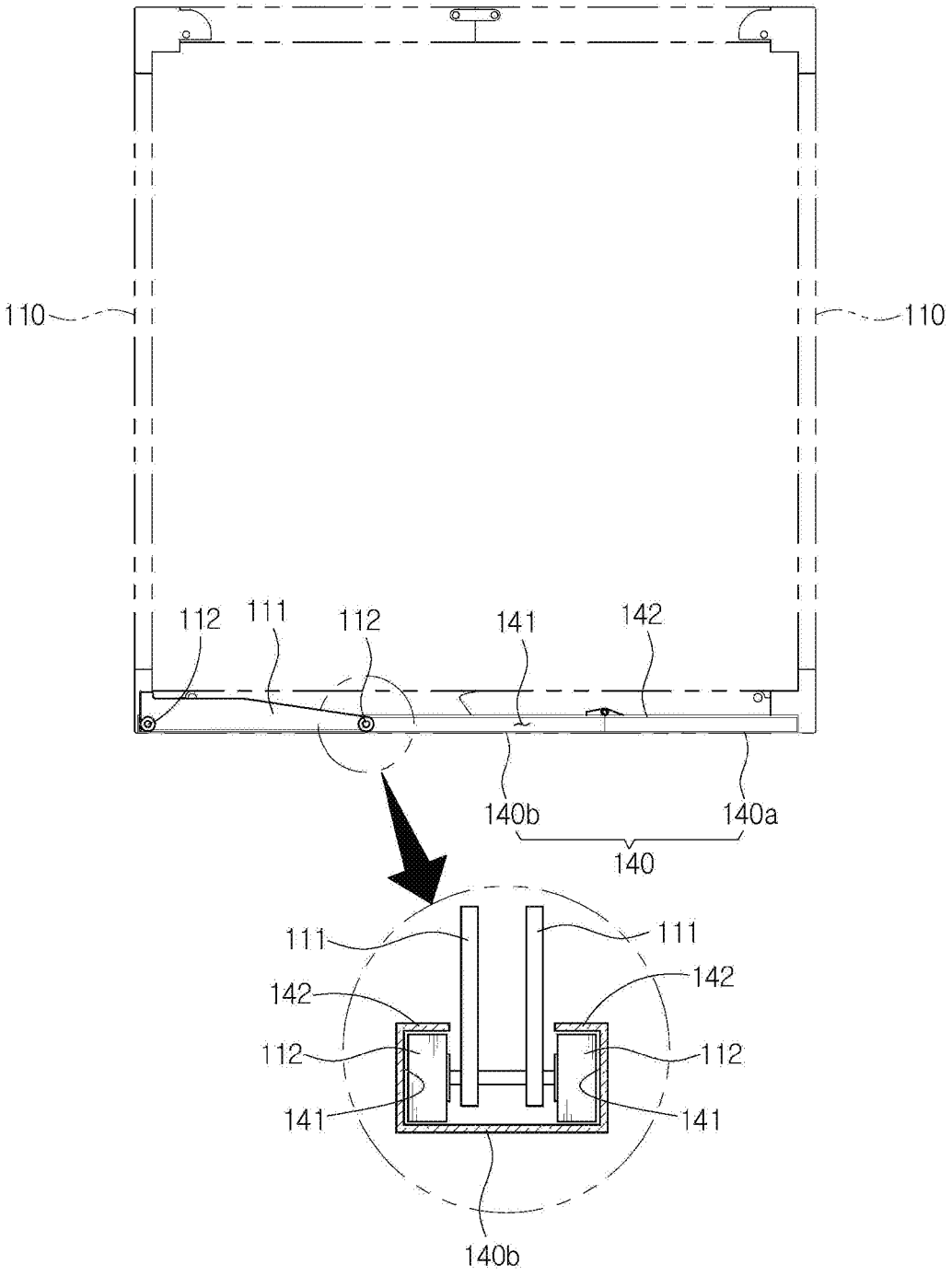
FIG. 6 are a cross-sectional view taken on line A-A' of FIG. 5, and a cross-sectional view illustrating a configuration of the guide rail of the foldable container of the present disclosure.
Figure 7:
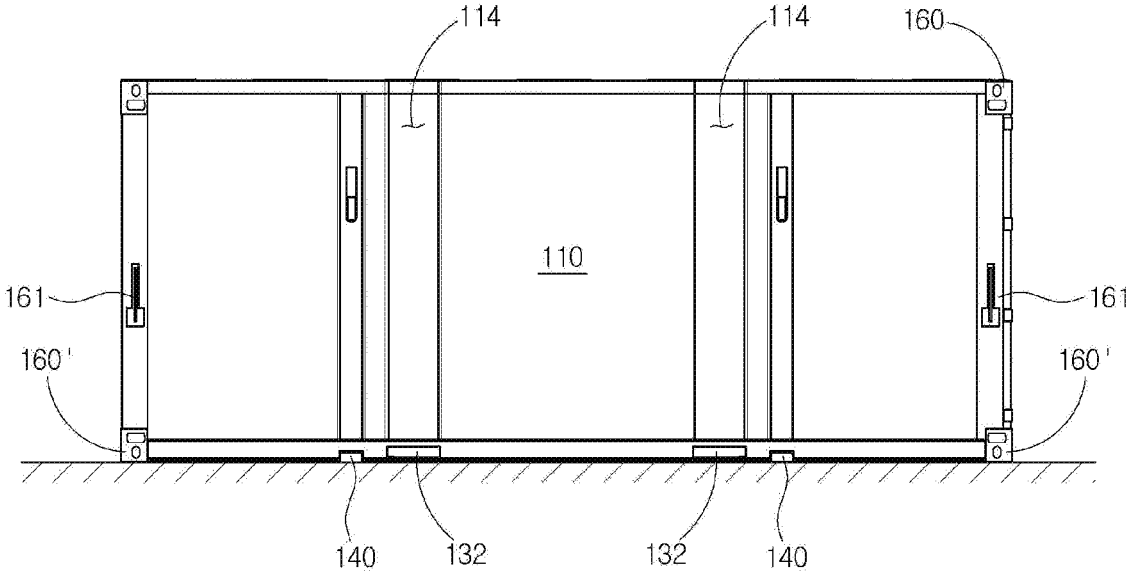
FIG. 7 is a side cross-sectional view of the foldable container of the present disclosure.

Of the attached drawings, FIG. 4 is a front cross-sectional view of the foldable container of the present disclosure, FIG. 5 is a plan cross-sectional view of the foldable container of the present disclosure, FIG. 6 are a cross-sectional view taken from a line A-A' of FIG. 5 and a cross-sectional view illustrating the configuration of the guide rail 140 of the foldable container 100 of the present disclosure, and FIG. 7 is a side cross-sectional view of the foldable container of the present disclosure.

As illustrated in FIG. 4 and FIG. 5, in a foldable container 100 of the present disclosure, in a state where one pair of side walls are disposed side-by-side and spaced apart from each other, the upper plate 120 and the lower plate 130 respectively connect the upper ends of the one pair of side walls 110 to each other, and the lower ends of the one pair of side walls 110 to each other, forming a generally square-shaped container 100. Here, end portions at both sides of the upper plate 120 and the lower plate 130 may each be rotatably connected to the one pair of side walls 110, and the center of each of the upper plate and the lower plate may be foldably connected so that the upper plate 120 and the lower plate 130 can be folded towards a space between the one pair of side walls 110.

Further, the opening region of the front surface and the rear surface of the container 100 may be opened/closed by the door 150 rotatably assembled to each of the front end and the rear end of the one pair of side walls 110, and each door 150 is rotatably connected to the side walls 110 by a hinge having a radius of rotation of approximately 360°, so that the door 150 can closely contact each of the inner surface and outer surface of the side wall 110. Further, in order to enable a lock in a state where the door 150 closed each of the front surface and the rear surface of the container 100, the door 150 may each be provided with a locking means.

At the lower portion of the one pair of side walls 110, the guide rail 140 is disposed in a direction in which the guide rail transverse-crosses between the side walls 110, thereby guiding the transverse movement of the side wall 110 for the container to be folded.

Specifically, as illustrated in FIG. 6, the first rail 140*a* forming the guide rail 140, is fixed to the lower end of the one side wall 110 of the pair of side walls, and the second rail 140*b* extends in a longitudinal direction from the end portion of the first rail 140*a*, to support the lower end of the other side wall 100 of the pair of side walls. Further, at the lower end of the other side wall 110 of the pair of side walls, the transfer cart 111 that may move along the first rail 140*a* and the second rail 140*b* is fixed, so that, by the movement of the other side wall 110 of the pair of side walls towards the one side wall 110 of the pair of side walls, the upper plate 120 and the lower plate 130 may be folded. Especially, in the process where the roller 112, formed at both sides of the front end and the rear end of the transfer cart 111, moves along the guide groove 141 formed at both sides of the first rail 140*a* and the second rail 140*b*, the roller 112 is prevented from deviating from the guide groove 141 towards the upper direction by the stopper 142 formed at the upper end of the guide groove 141, and thus the roller 112 may move along the guide rail 140 stably with the side walls 110 fixed to the transfer cart 111.

Meanwhile, on each of the plurality of unit plates forming the lower plate 130, a second fixing portion 131 is provided, enabling the lower plate 130 to be selectively fixed to the guide rail 140 on the lower portion.

Although not specifically illustrated in the drawings, as the fixing means disposed on the outer surface of the lower plate 130 is rotated by the handle disposed on the inner surface of the lower plate 130 to selectively engage the stopper 142 of the guide rail 140, the second fixing portion 131 may fix the lower plate 130 to the guide rail 141. Therefore, by such a second fixing portion 131, the lower plate 130 may be prevented from arbitrarily moving in a folding direction.

As aforementioned, the other side wall 110 of the pair of side walls is supported on the bottom surface through the guide rail 140 and is moveable along the guide rail 140. Meanwhile, as illustrated in FIG. 7, at both end portions at the lower side of the other side wall 110 of the pair of side walls, there is provided a corner fitting member 160' that may move up and down and that is supported on the bottom surface, thereby preventing the other side wall 110 of the pair of side walls from arbitrarily moving on the guide rail 140.

Further, the corner fitting member 160' may be selectively spaced apart from the bottom surface by the manipulating lever 161 provided on the side wall 110. Therefore, by the user's manipulation of the manipulating lever 161, the corner fitting member 160' may be supported on the bottom surface to prevent the other side wall 110 of the pair of side walls from moving arbitrarily, or be spaced apart from the bottom surface so that the other side wall 110 of the pair of side walls can move along the guide rail 140.

The foldable container 100 of the present disclosure that is assembled in the aforementioned unfolded state, may be folded in the following order to reduce the volume.

Figure 8:
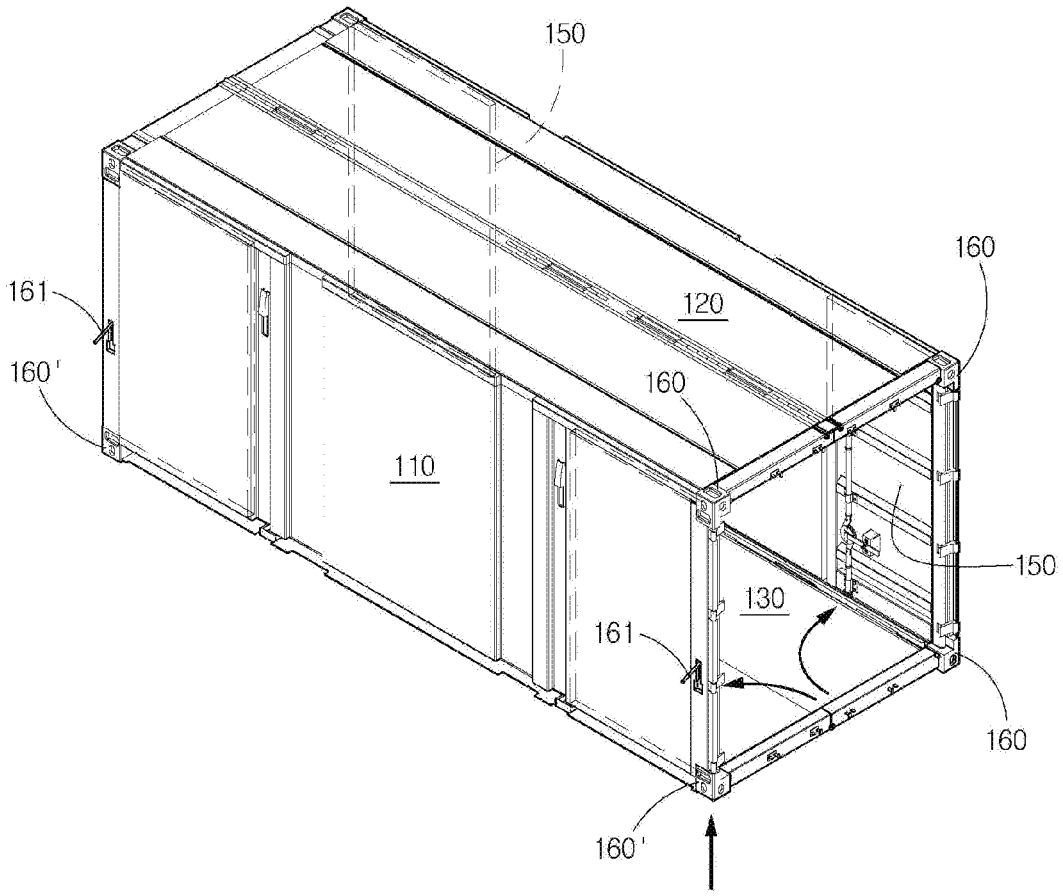
FIGS. 8 to 10 are action views illustrating a folding process of the foldable container of the present disclosure.
Figure 9:
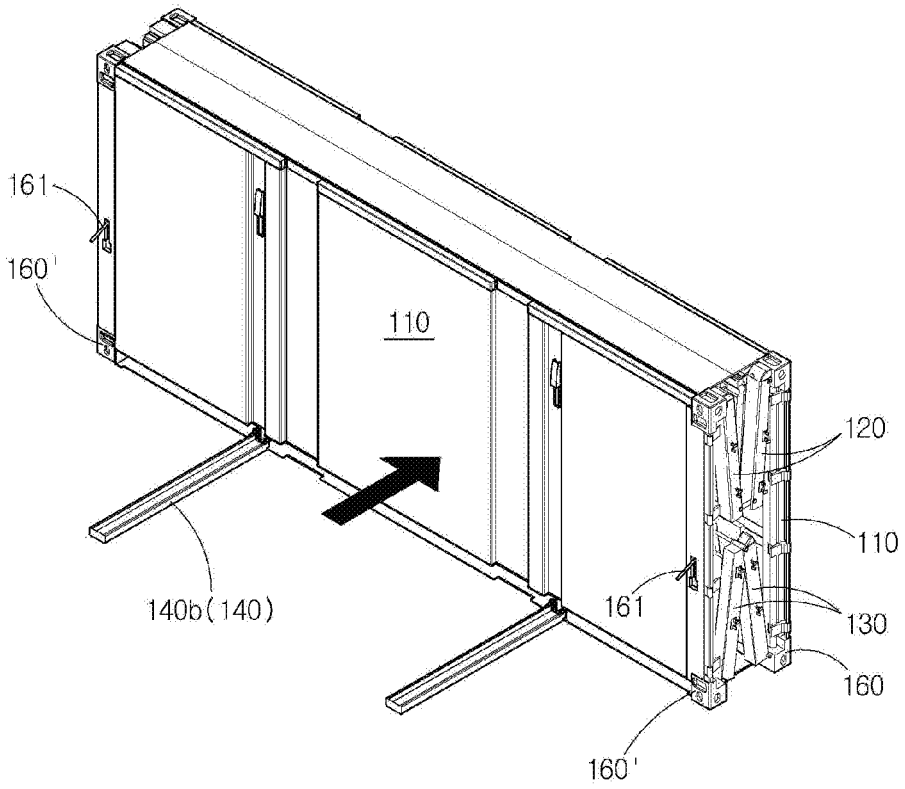
Figure 10:
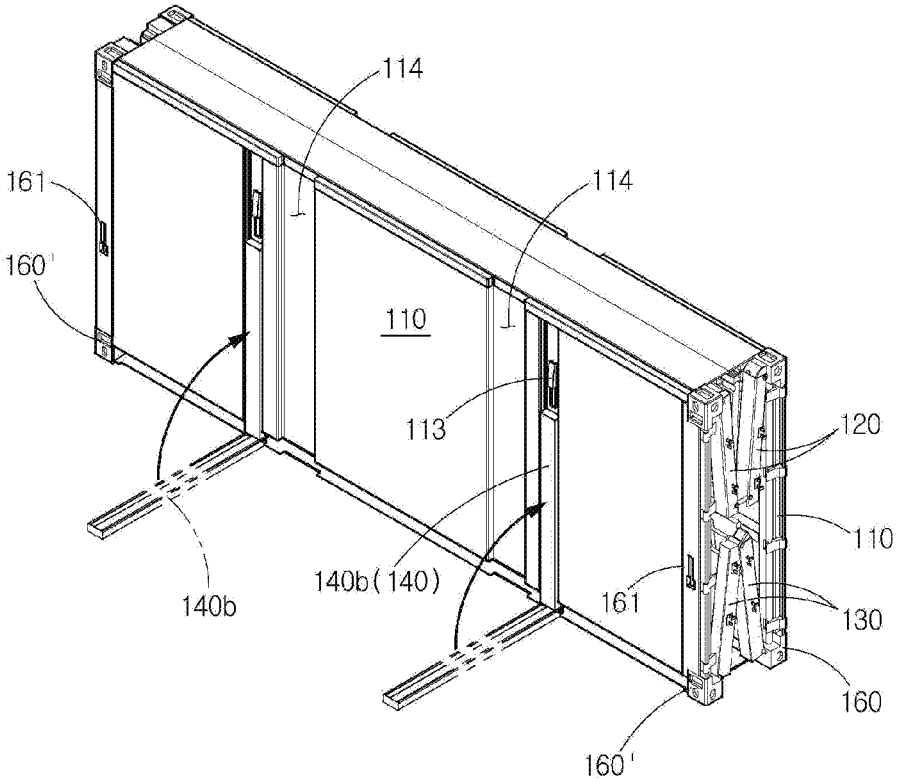

Of the attached drawings, FIGS. 8 to 10 are action views illustrating the folding process of the foldable container of the present disclosure.

First of all, as illustrated in FIG. 8, the door 150 rotatably connected to the front end and the rear end of each side wall 110, is rotated towards the inner surface of side wall 110, so as to open the front opening and the rear opening of the container 100, and then, the door 150 is fixed to the inner wall surface of the side wall 110.

Then, the second fixing portion 131 provided on the lower plate 130 is released from fixation so that the lower plate 130 can be folded in a direction away from the guide rail 140, and the corner fitting member 160' is moved upwards using the manipulating lever 161 provided on the side wall 110, so that the side wall 110 can move along the guide rail 140.

In a state where the lower plate 130 and the guide rail 140 are released from fixation so as to be foldable, and the corner fitting member 160' of the side wall 110 is spaced apart from the bottom surface as aforementioned, the other side wall 110 of the pair of side walls can move along the guide rail 140 and be disposed adjacent to the one side wall 110 of the pair of side walls, as illustrated in FIG. 9. Here, the upper plate 120 and the lower plate 130, respectively connecting the upper ends of the one pair of side walls 110, to each other, and the lower ends of the one pair of side walls 110, to each other, are folded at their central portion and accommodated into the space between the one pair of side walls 110, thereby significantly reducing the volume of the container.

Further, as illustrated in FIG. 10, in a state where the second rail **140*b* for guiding the movement of the other side wall 110 of the pair of side walls is rotated, to closely contact the outer surface of the other side wall 110 of the pair of side walls, if the second rail 140*b* is fixed by the first fixing portion 113 provided on the side wall 110, this means that the one side wall 110 of the pair of side walls is fixed to the first rail 140*a*, and the other side wall 110 of the pair of side walls is fixed to the second rail 140*b* connected to the first rail 140*a*, and thus it is possible to prevent the container 100** from being arbitrarily unfolded from the folded state.

Meanwhile, the process for unfolding the container from the aforementioned folded state is in the inverse order of the aforementioned folding process, and thus specific description will be omitted.

The right of the scope of the present disclosure is not limited to the aforementioned embodiments but may be realized in various types of embodiments within the claims attached hereto. It will be apparent to one of ordinary skill in the art that various changes in form and details may be made in these examples without departing from the spirit and scope of the claims and their equivalents.

What is claimed is:

1. A foldable container comprising:

a pair of side walls disposed side-by-side;

a guide rail disposed in a direction transverse-crossing between lower ends of the one pair of side walls to guide movement of at least one of the side walls;

an upper plate and a lower plate, wherein each of the upper plate and the lower plate is divided into at least two unit plates that are rotatably connected to each other so as to be folded by the movement of the side wall, and wherein each of the upper plate and the lower plate connects upper ends of the pair of side walls to each other and connects lower ends of the one pair of side walls to each other; and a door rotatably connected to each of a front end and a rear end of the side wall, wherein the guide rail includes a first rail fixed to one side wall of the pair of the side walls and a second rail rotatably connected to an end portion of the first rail to guide the movement of the other side wall of the pair of the side walls.

2. The foldable container according to claim 1, wherein a transfer cart configured to move along the guide rail is provided at the lower end of the side wall.

3. The foldable container according to claim 2, comprising a first fixing portion provided on an outer surface of the other side wall to selectively fix the second rail.

4. The foldable container according to claim 2, comprising a second fixing portion provided on the lower plate to selectively fix the lower plate to the first rail or to the second rail in a state where the lower plate is unfolded.

5. The foldable container according to claim 4, wherein the second fixing portion includes a fixing means disposed on an outer surface of the lower plate to be selectively engaged with the second rail, and a handle disposed on an inner surface of the lower plate to drive the fixing means in a fixing direction or in a releasing direction.

6. The foldable container according to claim 2, wherein a roller is provided at both end portions of the transfer cart, and the guide rail is provided with a guide groove configured to guide movement of the roller and a stopper that is disposed at an upper side of the guide groove to inhibit deviation of the roller.

7. The foldable container according to claim 6, comprising a first fixing portion provided on an outer surface of the other side wall to selectively fix the second rail.

8. The foldable container according to claim 6, comprising a second fixing portion provided on the lower plate to selectively fix the lower plate to the first rail or to the second rail in a state where the lower plate is unfolded.

9. The foldable container according to claim 8, wherein the second fixing portion includes a fixing means disposed on an outer surface of the lower plate to be selectively engaged with the second rail, and a handle disposed on an inner surface of the lower plate to drive the fixing means in a fixing direction or in a releasing direction.

10. The foldable container according to claim 1, comprising a first fixing portion provided on an outer surface of the other side wall to selectively fix the second rail.

11. The foldable container according to claim 1, comprising a second fixing portion provided on the lower plate to selectively fix the lower plate to the first rail or to the second rail in a state where the lower plate is unfolded.

12. The foldable container according to claim 11, wherein the second fixing portion includes a fixing means disposed on an outer surface of the lower plate to be selectively engaged with the second rail, and a handle disposed on an inner surface of the lower plate to drive the fixing means in a fixing direction or in a releasing direction.

13. The foldable container according to claim 1, comprising corner fitting members that are disposed at each corner of the one pair of side walls and that are supported on a bottom surface.

14. The foldable container according to claim 13, wherein, of the corner fitting members, the corner fitting member disposed at a lower end corner of the side wall moving along the guide rail is disposed so as to be moveable up and down in a height direction of the side wall, and the corner fitting members are selectively supported on the bottom surface while being moved up and down by a manipulating lever provided at the side wall.

15. The foldable container according to claim 13, wherein the corner fitting member is provided with a first coupling hole each formed at a position corresponding to an upper surface and a lower surface of the side wall and a second coupling hole each formed at a position corresponding to an outer surface of the side wall, and a distance between the second coupling holes of the corner fitting members disposed at an upper end corner and at a lower end corner of the side wall is set to be identical to a distance between the first coupling holes of the corner fitting members provided at the one pair of side walls.

16. The foldable container according to claim 1, wherein each of the lower plate and the side wall has a fork groove into which a fork of a transfer equipment is inserted.

* * * * *